US007762540B2

(12) United States Patent
Kushida et al.

(10) Patent No.: US 7,762,540 B2
(45) Date of Patent: Jul. 27, 2010

(54) SHEET PROCESSING APPARATUS AND IMAGE FORMING APPARATUS PROVIDED WITH THE SAME

(75) Inventors: Hideki Kushida, Moriya (JP); Taro Ikeda, Tokyo (JP); Hiroaki Takagishi, Tokyo (JP); Kenichi Hayashi, Abiko (JP); Tomokazu Nakamura, Matsudo (JP); Wataru Kawata, Kashiwa (JP); Hiromasa Katayama, Toride (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 12/358,413

(22) Filed: Jan. 23, 2009

(65) Prior Publication Data

US 2009/0140483 A1 Jun. 4, 2009

Related U.S. Application Data

(63) Continuation of application No. 11/169,786, filed on Jun. 30, 2005, now Pat. No. 7,530,560.

(30) Foreign Application Priority Data

Jul. 20, 2004 (JP) ..... 2004-211805

(51) Int. Cl.
*B65H 37/04* (2006.01)

(52) U.S. Cl. ..... 270/58.08; 270/37; 270/58.07; 270/58.09; 270/58.11; 270/58.12

(58) Field of Classification Search ..... 270/37, 270/58.07, 58.08, 58.09, 58.11, 58.12
See application file for complete search history.

(56) References Cited

U.S. PATENT DOCUMENTS 5,826,158 A 10/1998 Hirano et al.
5,881,352 A 3/1999 Kobayashi et al.
5,897,250 A 4/1999 Hirai et al.
5,911,414 A 6/1999 Kato et al.
6,237,910 B1 5/2001 Kawata (Continued)

FOREIGN PATENT DOCUMENTS

JP 3-146396 6/1991

(Continued)

*Primary Examiner*—Gene Crawford
*Assistant Examiner*—Leslie A Nicholson, III
(74) *Attorney, Agent, or Firm*—Fitzpatrick, Cella, Harper & Scinto

(57) ABSTRACT

When a sheet bundle is being conveyed by any one pair of plural pairs of rollers independently movable toward and away from the bundle sheet, before the bound portion of the sheet bundle passes the pair of rollers, the pair of rollers on the downstream side nearest to the bound portion are separated from the sheet bundle, and the pairs of rollers more downstream than that pair convey the sheet bundle. Thereby, it happens less often that the pairs of rollers gather the air collected between adjacent ones of the sheets of the sheet bundle to the bound portion to thereby cause a slack to the sheets, and the occurrence of wrinkles or twists in the sheet bundle can be reduced. Also, the pair of rollers are separated from the sheet bundle before the bound portion passes the pair of rollers, whereby it happens less often that the pair of rollers are damaged by the bound portion, and the sheet bundle can be conveyed smoothly.

7 Claims, 14 Drawing Sheets

U.S. PATENT DOCUMENTS

| | | | |
|---|---|---|---|
| 6,241,234 | B1 | 6/2001 | Saitoh et al. |
| 6,264,189 | B1 | 7/2001 | Kawata |
| 6,264,194 | B1 | 7/2001 | Hayashi et al. |
| 6,290,220 | B1 | 9/2001 | Takehara et al. |
| 6,305,681 | B1 | 10/2001 | Watanabe et al. |
| 6,505,829 | B2 | 1/2003 | Kawata |
| 6,793,216 | B2 | 9/2004 | Nakamura |
| 6,945,528 | B2 | 9/2005 | Nakamura |
| 6,957,810 | B2 | 10/2005 | Yamada et al. |
| 7,011,306 | B2 | 3/2006 | Kato et al. |
| 7,080,830 | B2 | 7/2006 | Suzuki et al. |
| 2003/0160376 | A1 | 8/2003 | Yamada et al. |
| 2004/0178556 | A1 | 9/2004 | Moteki |
| 2005/0082734 | A1 | 4/2005 | Goto et al. |
| 2005/0082735 | A1 | 4/2005 | Nakamura et al. |
| 2005/0084308 | A1 | 4/2005 | Nakamura et al. |
| 2005/0179190 | A1 | 8/2005 | Kamiya et al. |
| 2006/0017209 | A1 | 1/2006 | Kushida et al. |
| 2006/0017218 | A1 | 1/2006 | Kawata et al. |
| 2006/0018694 | A1 | 1/2006 | Hayashi |
| 2006/0019811 | A1 | 1/2006 | Ikeda et al. |

FOREIGN PATENT DOCUMENTS

| | | |
|---|---|---|
| JP | 11-322171 | 11/1999 |
| JP | 2003-155155 | 5/2003 |

SHEET PROCESSING APPARATUS AND IMAGE FORMING APPARATUS PROVIDED WITH THE SAME

This is a continuation of U.S. patent application Ser. No. 11/169,786, filed Jun. 30, 2005, now pending.

BACKGROUND OF THE INVENTION

1. Field of the Invention

The invention relates to a sheet processing apparatus for effecting process on a sheet bundle, particularly a sheet processing apparatus which reduces the occurrence of wrinkles, twists or the like to a sheet bundle when conveyed after process, and an image forming apparatus provided with this sheet processing apparatus in the apparatus main body thereof.

2. Related Background Art

There is, for example, a sheet processing apparatus which binds sheets into the shape of a bundle. Such a sheet processing apparatus is sometimes provided as one of the constituents of an image forming apparatus in the apparatus main body of the image forming apparatus (see Japanese Patent Application Laid-open No. H11-322171). Image forming apparatuses include a copying machine, a printing machine, a laser beam printer and a compound machine of these.

A conventional sheet processing apparatus 901 shown in FIG. 14 of the accompanying drawings is adapted to perform the aligning process of aligning the end portion of a sheet bundle, the side stitching bookbinding of binding the end portion of the sheet bundle, the saddle stitching bookbinding of binding the middle and the vicinity of the middle of the sheet bundle, and then folding the sheet bundle in two to thereby form it into the shape of a brochure, etc.

That is, the conventional sheet processing apparatus 901 receives sheets P having images formed on one side or two sides thereof in the apparatus main body 903 of an image forming apparatus 902 in succession by an intermediate tray 906 and at the same time, aligns the widths of the sheets by a width aligning device 907 to thereby form the sheets into the shape of a bundle. Thereafter, the sheet aligning apparatus 901 staples the edge portion of the sheet bundle by an end portion stapler unit 908, and discharges the sheet bundle to a sheet stacking portion 904 by a pair of sheet discharging rollers 909. Thus, the conventional sheet processing apparatus 901 shown in FIG. 14 can bind the edge portion of the sheet bundle.

Also, the conventional sheet processing apparatus 901 stacks the sheets successively received from the apparatus main body 903 of the image forming apparatus 902 onto a saddle stitching process tray 910 formed substantially straight at a steep slope, and receives them by a stopper 911 and forms them into the shape of a bundle. The sheet processing apparatus 901 effects the width alignment of the sheets P by a width aligning device (not shown) and thereafter staples substantially the vicinity of the middle of the sheet bundle at two locations by an intermediate portion stapler unit 912. Thereafter, the sheet processing apparatus 901 moves the stopper 911 to thereby oppose the stapled portion of the stapled sheet bundle to the nip between a pair of sheet folding rollers 914 and a sheet thrusting plate 913. Then, the sheet processing apparatus 901 thrusts the stapled portion of the sheet bundle by the sheet thrusting plate 913 to thereby feed the sheet bundle into the nip between the pair of sheet folding rollers 914, and folds the sheet bundle into two while nipping and conveying the sheet bundle by the pair of sheet folding rollers 914. Lastly, the sheet processing apparatus 901 discharges the sheet bundle to a sheet stacking portion 905 by a pair of sheet discharging rollers 915. Thus, the conventional sheet processing apparatus 901 shown in FIG. 14 can also form the sheet bundle into the shape of a twofold brochure.

The conventional sheet processing apparatus, however, also nips needles or staples when it discharges the sheet bundle while nipping and rotating the sheet bundle by the pair of sheet discharging rollers 909 in a case where the sheet bundle is bound by the needles and therefore, the pair of sheet discharging rollers 909 have sometimes been damaged.

On the other hand, in recent years, business machines are in the tendency toward a reduction in overlooking area and multiple functions in order to meet a requirement for space saving and users' various requirements. The sheet processing apparatus used also as a business machine are likewise in the tendency toward a reduction in overlooking area and multiple functions. Therefore, even if an attempt is made to contrive a reduction in overlooking area and multiple functions by changing the disposed locations of the end portion stapler unit 908, the intermediate portion stapler unit 912, etc., it is often the case that the stapled sheet bundle is conveyed by a pair of rollers as a plurality of conveying means. Therefore, when the sheet bundle is being conveyed by the pair of rollers, it has sometimes happened that the air collected between adjacent sheets of the stapled sheet bundle is gathered into the stapled portion to thereby form a slack in the sheets. When the sheet bundle is conveyed with a slack thus formed in the sheets, wrinkles or twists have sometimes occurred to the sheets.

SUMMARY OF THE INVENTION

The present invention has as its object to provide a sheet processing apparatus which reduces wrinkles or twists occurring to a sheet bundle and also reduces damage caused by needles when a sheet bundle bound by the needles is conveyed.

In order to achieve the above object, the sheet processing apparatus of the present invention is provided with a stacking portion on which sheets are stacked, a binding unit which binds a sheet bundle stacked on the stacking portion, and a conveying portion which conveys the sheet bundle bound by the binding unit, wherein a plurality of conveying portions are arranged along a sheet conveying direction for independent movement toward and away from the bound sheet bundle, and of the plurality of conveying portions, the conveying portion located on a downstream side nearest to the bound portion of the conveyed sheet bundle bound by the binding unit is spaced apart from the sheet bundle, and the conveying portion more downstream than the aforementioned conveying portion conveys the sheet bundle.

In the sheet processing apparatus of the present invention, when the sheet bundle is being conveyed by the plurality of conveying portion, the conveying portion through which the bound portion of the sheet bundle passes is spaced apart from the sheet bundle and therefore, the occurrence of a slack in the sheets caused by the air collected between adjacent ones of the sheets of the sheet bundle being gathered to the bound portion, and wrinkles or twists formed in the sheet bundle can be reduced.

Also, the conveying portion through which the bound portion passes is moved away from the sheet bundle, whereby the conveying portion is little damaged by the bound portion, and the sheet bundle can be conveyed smoothly.

DESCRIPTION OF THE PREFERRED EMBODIMENTS

Figure 1:
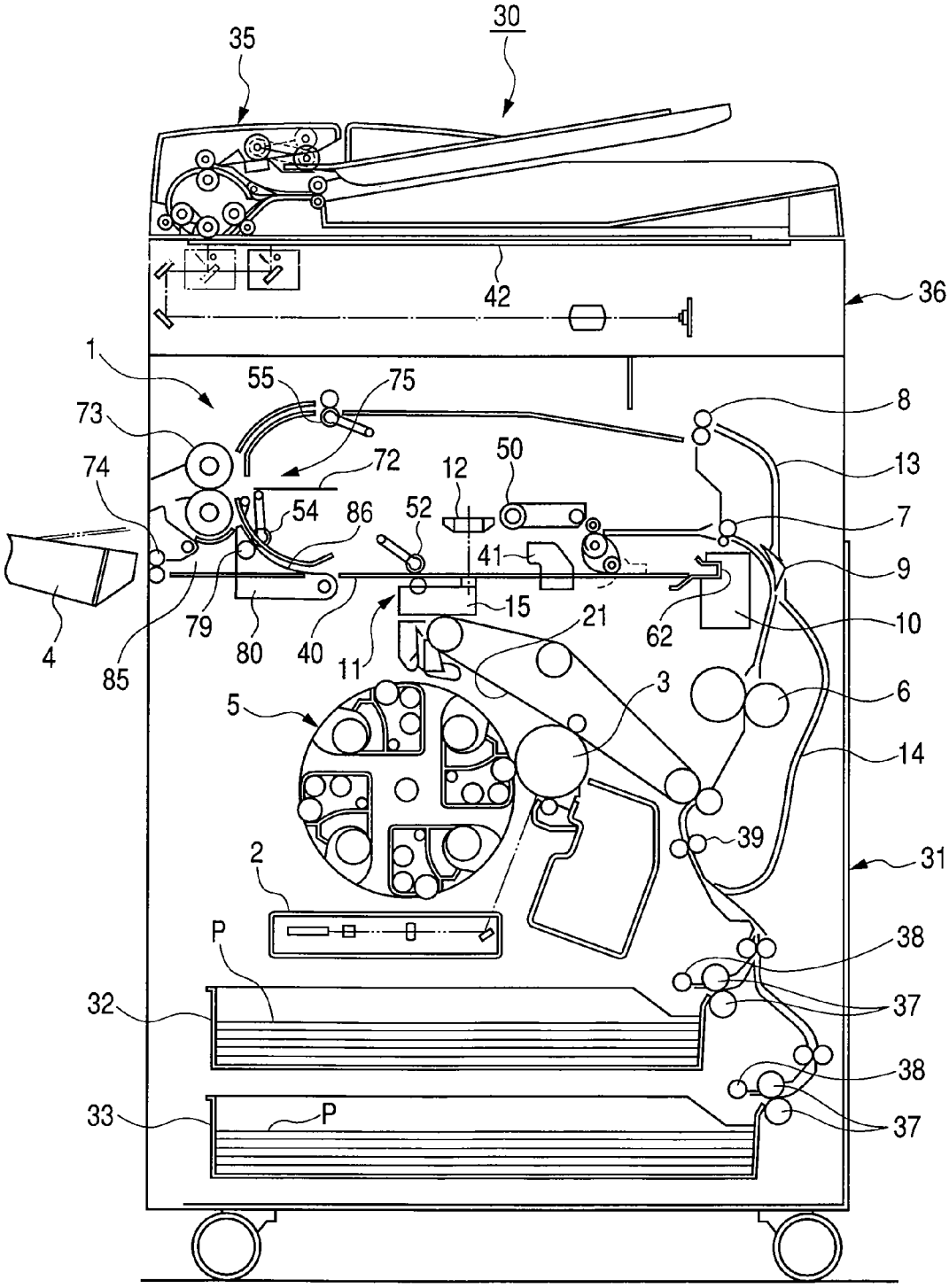
FIG. 1 is a schematic front cross-sectional view of a color copying machine as an image forming apparatus according to a first embodiment of the present invention.

An image forming apparatus and a sheet processing apparatus according to an embodiment of the present invention will hereinafter be described with reference to the drawings.

(Image Forming Apparatus)

A color copying machine as an image forming apparatus will first be described with reference to FIG. 1. As the image forming apparatus, there is a copying machine, a printing machine, a laser beam printer or a compound machine of these. The image forming apparatus according to the embodiment of the present invention is a multi-color copying machine, but this is not restrictive.

The color copying machine 30 has an apparatus main body 31, a sheet processing apparatus 1, an image reading apparatus 36 and an original supplying apparatus 35 in succession from below. The original supplying apparatus 35 is adapted to automatically supply an original to the image reading apparatus 36. The image reading apparatus 36 as reading means is adapted to read the original supplied by the original supplying apparatus 35, or an original placed on an original plate 42 by a user with the original supplying apparatus 35 opened rearwardly. The image reading apparatus 36 need not always be provided. Also, even if the image reading apparatus 36 is provided, the original supplying apparatus 35 need not always be provided. Further, the color copying machine 30 is of a so-called in-body discharge type because a sheet is discharged to the sheet processing apparatus 1 between the apparatus main body 31 and the image reading apparatus 36. The sheet processing apparatus 1 may be detachably mountable.

Description will now be made of the operation of the color copying machine. The original supplying apparatus 35 automatically feeds an original to the reading position of the image reading apparatus 36. The image reading apparatus 36 reads the image of the original. A controller (not shown) sends a signal to a laser scanner unit 2 on the basis of image information read by the image reading apparatus 36. The laser scanner unit 2 applies a laser beam to a photosensitive drum 3 as image forming means of which the surface has been uniformly charged. The image information signal the laser scanner unit 2 receives may be an image information signal sent from an external personal computer. Also when the image reading apparatus 36 is not provided, the laser scanner unit 2 applies a laser beam to the photosensitive drum 3 on the basis of an image signal sent from the outside.

An electrostatic latent image on the photosensitive drum 3 is toner-developed by a developing device 5 and becomes a toner image. The toner image is transferred to a transfer belt 21, and thereafter is transferred to a sheet P such as paper or an OHP sheet.

On the other hand, sheets P are suitably selectively paid away from sheet cassettes 32 and 33 by a pickup roller 38, and are separated one by one by a pair of separating rollers 37, and are fed to a pair of registration rollers 39. The sheet P has its skew feeding corrected by the pair of registration rollers 39, and thereafter is fed to a transferring position in synchronism with the rotation of the photosensitive drum 3 and the transfer belt 21. As a result, the toner image on the transfer belt 21 is transferred to the sheet P.

Thereafter, the sheet P is guided to a pair of fixing rollers 6, and is heated and pressurized by the pair of fixing rollers 6, whereby the toner image thereon is permanently fixed. A fixing upper separation pawl and a fixing lower separation pawl are in contact with the pair of fixing rollers 6, respectively, and the sheet P is separated from the pair of fixing rollers 6 by these pawls.

The separated sheet P, if it is set to one-side print, is fed from the apparatus main body 31 of the color copying machine into the sheet processing apparatus 1 by a pair of first discharge rollers 7. Also, the separated sheet P, if it is set to two-side print, is guided to a conveying path 13 by a direction switching flapper 9, and has its leading edge portion discharged to the outside of the apparatus main body 31 by a pair of second discharge rollers 8. When the trailing edge portion of the sheet P passes the direction switching flapper 9, the pair of second discharge rollers 8 are reversely rotated and the sheet P is guided to a conveying path 14 by the direction switching flapper 9. Thus, the sheet P has been reversed, and is again fed to the transfer belt 21, whereby a toner image is transferred to the back of the sheet P. Thereafter, the sheet P is heated and pressurized by the pair of fixing rollers 6, whereby the toner image thereon is fixed, and the sheet P is fed from the apparatus main body 31 into the sheet processing apparatus 1 by the pair of first discharge rollers 7.

(Sheet Processing Apparatus According to the First Embodiment)

The sheet processing apparatus will now be described with reference to FIGS. 1 to 10A and 10B. The sheet processing apparatus according to the present embodiment is incorporated in the color copying machine, but may be incorporated in a printing machine, a laser beam printer or the like. The sheet processing apparatus according to the present embodiment is incorporated not only in the color copying machine.

The sheet processing apparatus 1 is adapted to perform aligning process (sorting process) of forming the sheets fed from the apparatus main body 31 of the color copying machine 30 into the shape of a bundle and aligning the sheets, side stitching bookbinding (staple sorting process) of binding the end portion of the sheet bundle by an end portion stapler 10, and saddle stitching bookbinding (saddle stitching process) of binding the sheet bundle at the middle thereof and the vicinity of the middle portion by an intermediate portion stapler 11, and then folding the sheet bundle into two by a folding device 75 and forming it into the shape of a brochure.

In FIG. 1, the sheet processing apparatus 1 is provided with a process tray 40 as stacking means disposed on the upstream side with respect to a sheet conveying direction, a vertically movable stack tray 4 disposed on the downstream side, second, third and fourth rockable rollers 52, 54 and 55 as conveying means for conveying the sheet bundle and second, third and fourth drive rollers 57, 79 and 58 forming pairs with these, a pair of final discharge rollers 74, etc. A first rockable roller and a first drive roller are absent. Also, the conveying means may be a pair of belts comprising two circulating belts. Accordingly, the conveying means is not restricted to the pair of rollers.

The sheet processing apparatus 1 according to the present embodiment has a case where it forms the sheets P discharged by the pair of first discharge rollers 7 of the color copying machine 30 into the shape of a bundle on the process tray 40 and intactly discharges the sheets onto the stack tray 4, a case where it binds the edge portion of the sheet bundle by the end portion stapler 10 as end portion binding means and discharges the sheet bundle onto the stack tray 4, and a case where it binds the sheet bundle by the intermediate portion stapler 11 as intermediate portion binding means for binding the intermediate portion of the sheet bundle, and folds the sheet bundle into two on the sheet thrusting plate 72 and the pair of sheet folding rollers 73 so as to be formed into the shape of a brochure, and discharges it onto the stack tray 4. The intermediate portion stapler 11 is comprised of an anvil 11 and a driver 15. The anvil 11 is adapted to be moved toward and away from the driver 15.

Therefore, the sheet processing apparatus 1 is provided with a straight path 85 as a first guide path for guiding the sheet bundle bound or not bound by the end portion stapler 10, and a curved path 86 as a curved second guide path for guiding the sheet bundle bound by the intermediate portion stapler 11 to the sheet thrusting plate 72 and the pair of sheet folding rollers 73. The curved path 86 is curved in a direction to branch off from the straight path 45 and separate from the straight path 45. The sheet thrusting plate 72 and the pair of sheet folding rollers 73 together constitute the folding device 75 which is folding means.

(Description of the Operation During the Sorting Process and the Side Stitching Bookbinding)

Figure 2A:
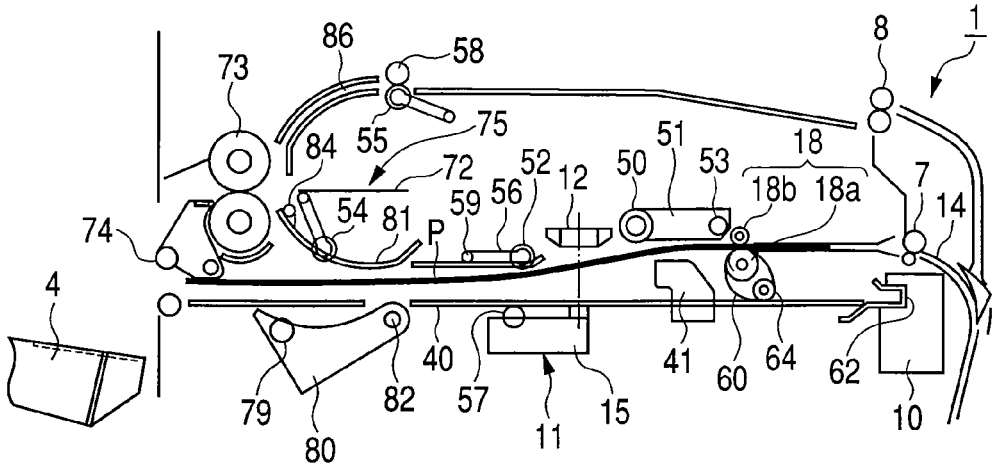
FIG. 2A is a view for illustrating the operation of side stitching process by a sheet processing apparatus in the first embodiment of the present invention, and showing sheets as they have been fed onto a process tray.

The operation of the sheet processing apparatus 1 during the side stitching sorting process will now be described with reference to FIGS. 2A-2C and FIGS. 3A-3B. As shown in FIG. 2A, the sheet processing apparatus 1 discharges the sheet P discharged from the pair of first discharge rollers 7 of the apparatus main body 31 of the color copying machine toward the process tray 40 by a pair of sorting discharge rollers 18. The pair of sorting discharge rollers 18 are comprised of a drive roller 18*a* and a driven roller 18*b*. At this time, a curved lower guide 80 disposed downstream of the pair of sorting discharge rollers 18 is pivotally moved downwardly of the process tray 40 about a rotary shaft 82 and is retracted. The curved lower guide 80 is provided with a third drive roller 79. Also, a curved upper guide 81 is upwardly pivotally moved about a rotary shaft 84 and is retracted. The third rockable roller 54 is also upwardly retracted with the curved upper guide 81. This third rockable roller 54 is adapted to cooperate with the aforedescribed third drive roller 79 to nip and convey the sheet. Further, the first rockable roller 50 and the second rockable roller 52 are also upwardly retracted. Also, the pair of final discharge rollers 74 are opened. As described above, each roller is retracted from the process tray 40 and therefore, the sheets P discharged from the pair of sorting discharge rollers 18 are stacked on the process tray 40.

Figure 2B:
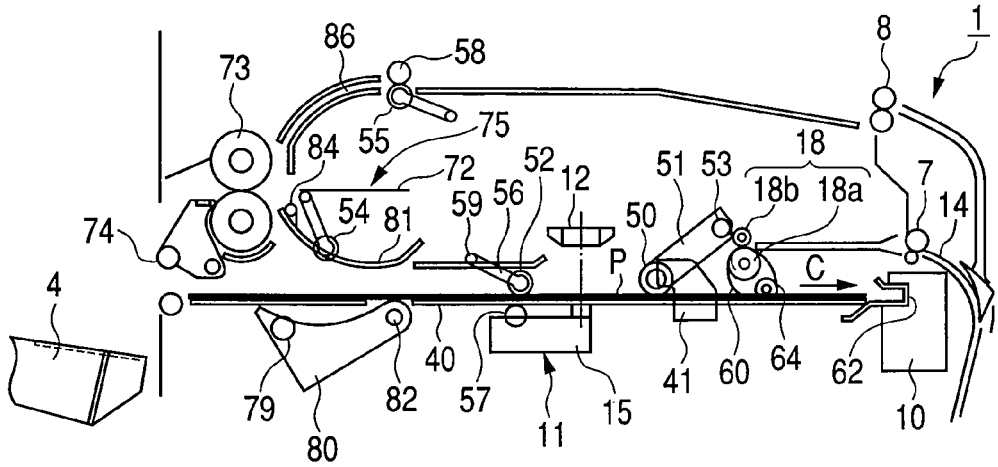
FIG. 2B shows sheets on the process tray when brought into contact with a stopper.

When the trailing edge of the sheet P is discharged from the pair of sorting discharge rollers 18, the first rockable roller 50 is rotatively moved in a counter-clockwise direction about a rockable roller shaft 53 and is rotated in the counter-clockwise direction, as shown in FIGS. 2A and 2B. Also, the second rockable roller 52 is rotatively moved in a clockwise direction about a rocking center shaft 59. The sheet P is urged against the process tray 40 and is moved in a direction (the direction indicated by the arrow C) opposite to the direction in which it has been discharged. Also, a return belt 60 is rotated in the counter-clockwise direction with the drive roller 18*a* to thereby help the reverse feeding of the sheet P. Then, the sheet P is received by a trailing edge stopper 62 disposed on an end portion of the process tray 40, and has its trailing edge arranged properly. That is, it has its trailing edge aligned. Also, the sheet P has its width properly arranged by a pair of aligning plates 41 (seen as one by overlap in FIGS. 2A-2C). That is, it has its side edges aligned. The pair of aligning plates 41 are adapted to be moved toward and away from each other in the width direction of the sheet by a drive source comprised, for example, of a rack and a pinion gear (not shown) and a control device for operation-controlling this drive source. Also, the first rockable roller 50 is mounted on the rockable end portion of a rockable arm 51 rockable in a vertical direction about the rockable roller shaft 53. The above-described operation is performed each time a sheet is discharged onto the process tray 40, and the sheets have their trailing edges and opposite side edges aligned and are stacked in the shape of a bundle on the process tray 40.

Figure 2C:
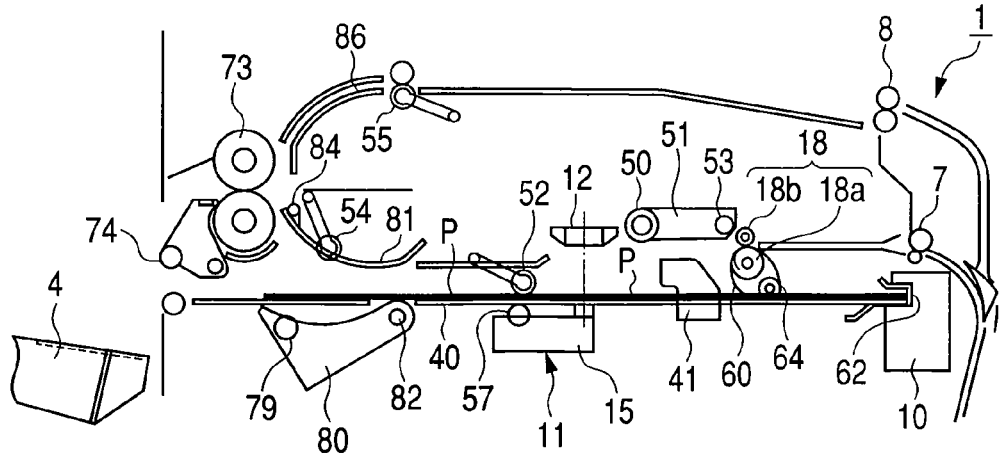
FIG. 2C shows a predetermined number of sheets as they are stacked on the process tray.
Figure 3A:
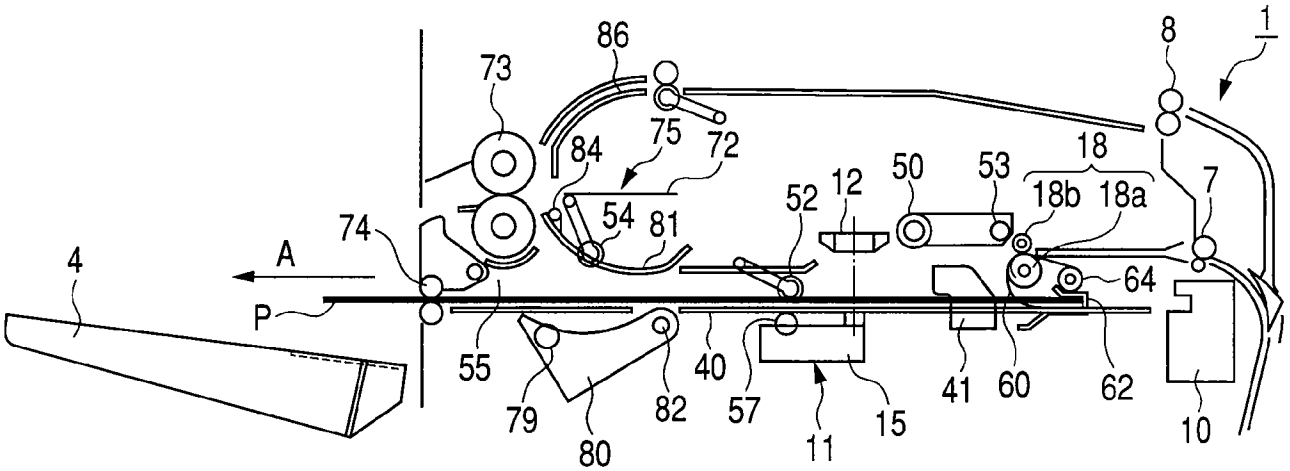
FIG. 3A is a view for illustrating the operation of the side stitching process continued from FIGS. 2A-2C, and showing the sheet bundle as it is discharged onto a stack tray.
Figure 3B:
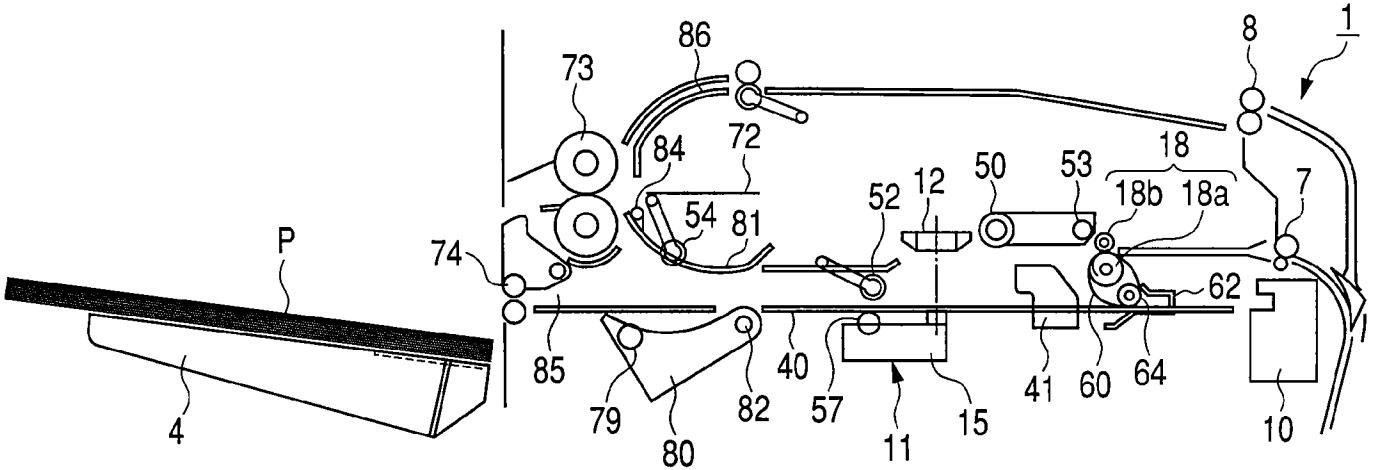
FIG. 3B shows the sheet bundle as it has been discharged onto the stack tray.

When as shown in FIG. 2C, a predetermined number of sheets are stacked on the process tray 40, the pair of final discharge rollers 74 are closed as shown in FIG. 3A. The sheet bundle, as shown in FIG. 3B, is conveyed in the direction indicated by the arrow A by the trailing edge stopper 62 having a U-shaped cross section, the second rockable roller 52 and the second drive roller 57 opposed thereto, and the pair of final discharge rollers 74, and is stacked on the stack tray 4. When the sheet bundle is being conveyed in the direction indicated by the arrow A, a return belt pulley 64 is moved away from the process tray 40 to thereby raise the return belt 60 from the inside thereof. The return belt 60 separates from the sheet bundle being conveyed in the direction indicated by the arrow A so as not to hinder the conveyance of the sheet bundle.

The above description of the operation is the description of the operation when the sheets are discharged in the shape of a bundle to the stack tray 4, but when the trailing edge portion (the right edge portion as viewed in FIGS. 2A-2C and FIGS. 3A and 3B) of the sheet bundle is to be bound, a predetermined number of sheets are stacked on the process tray 40 and assume the shape of a bundle, and the trailing edges and side edges of the sheets are aligned, whereafter the end portion stapler 10 is adapted to operate and bind the sheet bundle.

In this case, the second rockable roller 52 and the pair of final discharge rollers 74 successively separate from the sheet bundle as needles (staples) which have bound the end portion of the sheet bundle approach them, to thereby reduce the occurrence of a slack caused in the sheets by the air collected between adjacent sheets, whereby the occurrence of wrinkles or twists can be reduced. The reason why a stack is formed in the sheets will be described later with reference to FIGS. 8A and 8B. Also, when the second rockable roller 52 and the pair of final discharge rollers 74 successively separate from the sheet bundle, the occurrence of wrinkles or twists becomes little and thus, it never happens that the bound portion of the sheet bundle is damaged by the needles. The second rockable roller 52 may separate from the sheet bundle so that the sheet bundle may be conveyed for discharge by only the pair of final discharge rollers 74.

(Description of the Operation During Saddle Stitching Process)

The saddle stitching operation will now be described with reference to FIGS. 4 to 7.

Figure 4A:
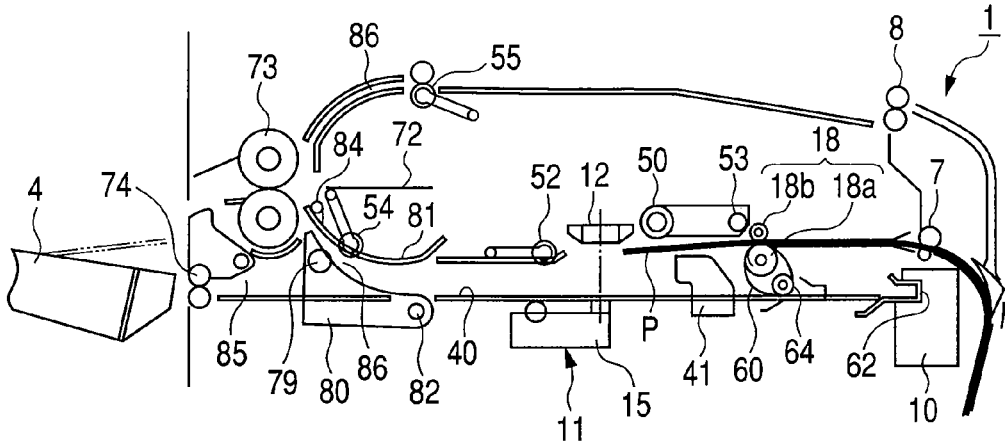
FIG. 4A is an illustration of the operation during the saddle stitching process by the sheet processing apparatus in the first embodiment of the present invention, and shows the sheets as they have been fed into the sheet processing apparatus.

As shown in FIG. 4A, the sheet P sent from the apparatus main body 31 of the color copying machine 30 is discharged onto the process tray 40 by the pair of sorting discharge rollers 18. Since the process setting is selected to the saddle stitching process, the curved lower guide 80 stands by at a position for guiding the sheet bundle, together with the third drive roller 79. Also, the curved upper guide 81 is upwardly rotated about the rotary shaft 84 together with the third rockable roller 54 and is retracted. Further, the second rockable roller 52 is spaced apart from the second drive roller 57 and is upwardly retracted. In this manner, the sheet processing apparatus 1 is prepared for the sheets to be stacked on the process tray 40.

Figure 4B:
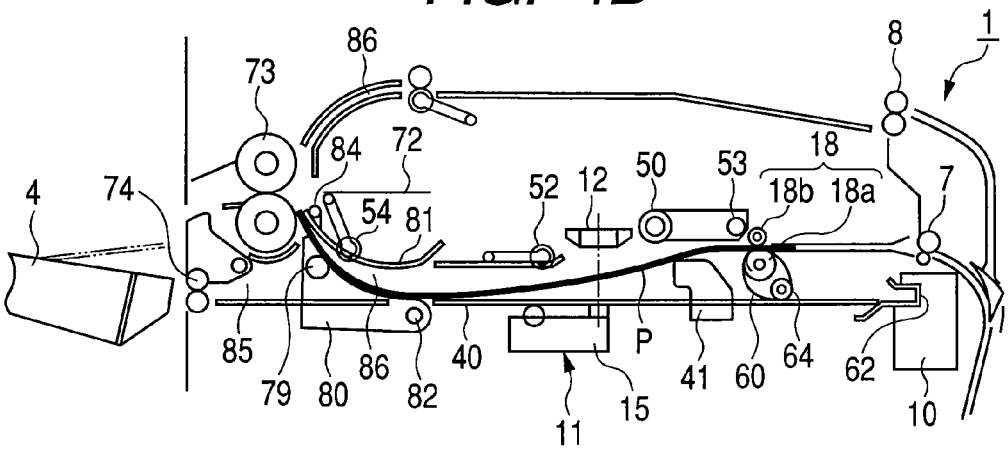
FIG. 4B shows the sheets as they have been fed onto the process tray.
Figure 4C:
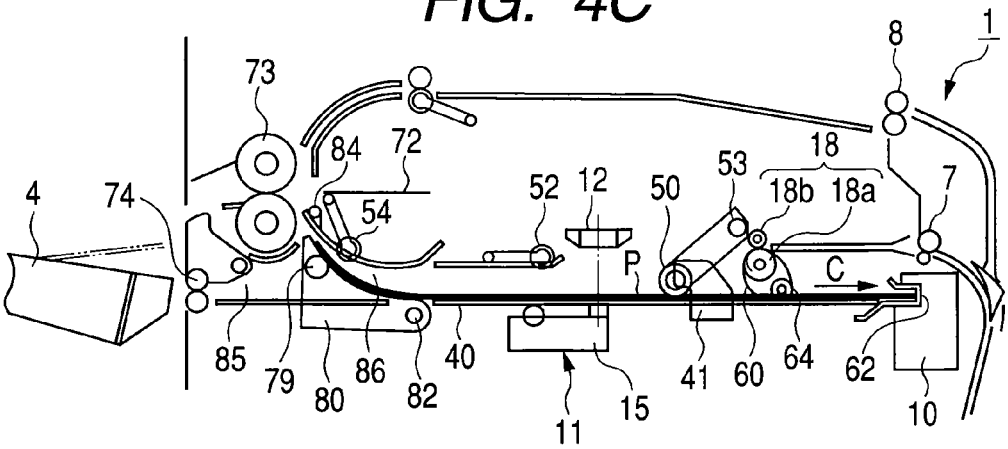
FIG. 4C shows the time when the sheets on the process tray are brought into contact with the stopper.

When the trailing edge of the sheet P is discharged from the pair of sorting discharge rollers 18, as in the aforedescribed side stitching bookbinding and sorting process, the first rockable roller 50 is counter-clockwisely rotatively moved about the rockable roller shaft 53 and is rotated in the counter-clockwise direction, as shown in FIGS. 4A to 4C. The leading edge (the left edge as viewed in FIG. 4C) of the sheets stacked on the process tray 40, depending on the length of the sheets, is guided by the curved lower guide 80 and has entered the curved path 86. The sheets stacked on the process tray 40 are conveyed on the process tray 40 in the direction indicated by the arrow C opposite to the direction in which they have so far conveyed, by the return belt 60 and the first rockable roller 50, and have their edge portions (the right edges as viewed in FIG. 4C) intersecting with the sheet conveying direction aligned. Also, the sheet bundle has its side edge portions along the width direction of the sheet aligned by the aligning plates 41.

Figure 5A:
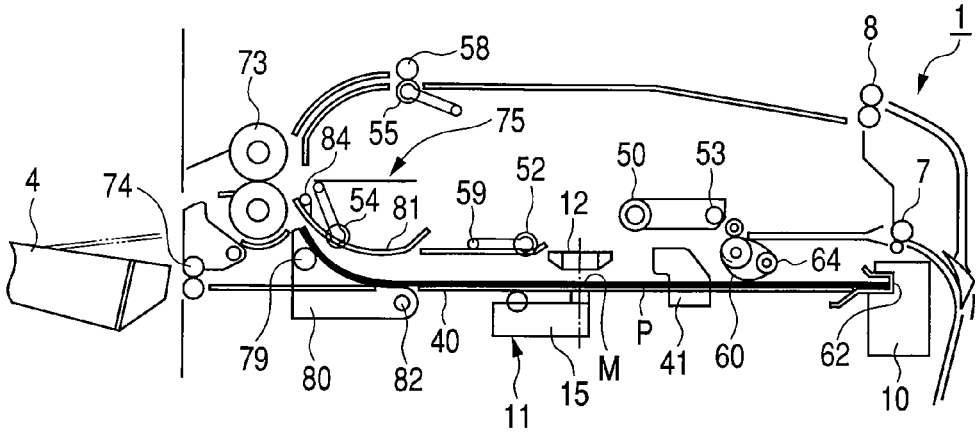
FIG. 5A is a view for illustrating the operation during the saddle stitching process continued from FIGS. 4A-4C, and showing a predetermined number of sheets as they have been stacked on the process tray.

The sheet processing apparatus 1, when it has effected the alignment of the edge portions and side edge portions of the sheets P, binds substantially the middle of the sheet bundle S by the intermediate portion stapler 11 installed so as to be astride of the process tray 40, as shown in FIG. 5A. The sheet bundle is bound at two locations in a direction intersecting with the sheet conveying direction, by needles as binding members. The sheet processing apparatus 1 according to the present embodiment has two intermediate portion staplers arranged in the width direction of the sheet and is adapted to bind the sheet bundle at two locations. Therefore, it can shorten the binding process time as compared with a case where a single intermediate portion stapler 11 is moved in the width direction of the sheet to thereby needle-bind the sheet bundle at two locations, but the number of the intermediate portion stapler may be one.

The sheet processing apparatus 1, when it finishes the binding process of the intermediate portion of the sheets, conveys the sheet bundle until as shown in FIGS. 5B to 6B, the needle-bound portion M of the sheet bundle becomes coincident with the nip portion of the pair of sheet folding rollers 73 and the sheet thrusting plate 72 by the third rockable roller 54 and the fourth rockable roller 55.

Figure 5B:
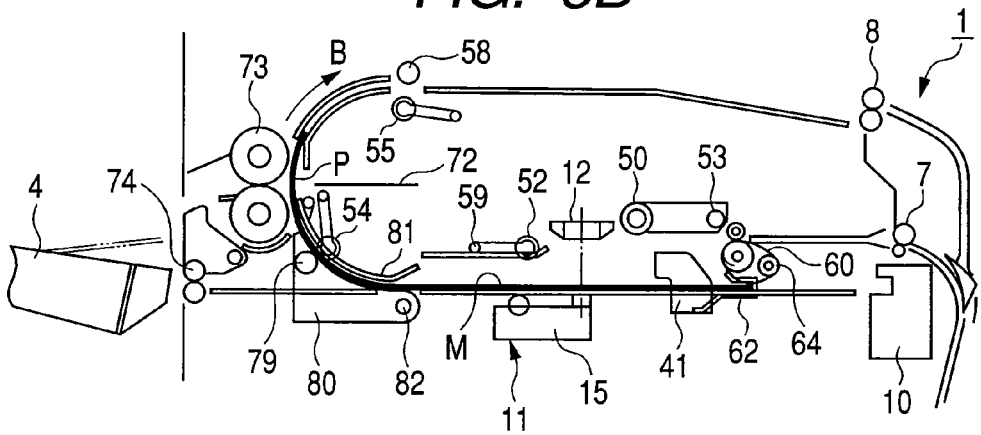
FIG. 5B shows the sheet bundle as it is conveyed to a folding device.

That is, as shown in FIG. 5B, the sheets P needle-bound substantially at the middle portion thereof is conveyed in the direction indicated by the arrow B by the pressure of the trailing edge stopper 62. At this time, the second rockable roller 52 located downstream of the needle-bounded portion M with respect to the conveying direction is already separated from the sheet bundle P and is retracted. The reason is as follows.

Figure 8A:
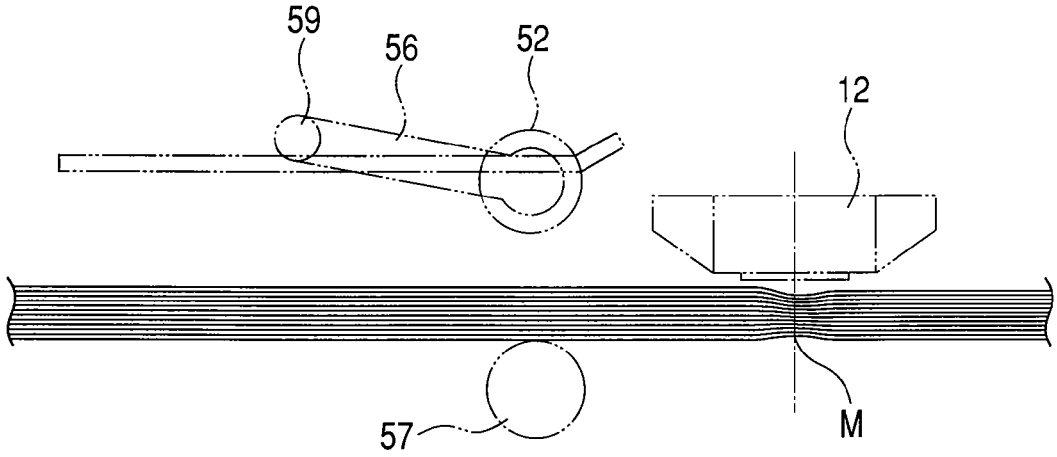
FIG. 8A is a view illustrating a process in which a slack and a wrinkle are formed in the sheets of the sheet bundle, and showing the sheet bundle as it has been stapled by a stapler.
Figure 8B:
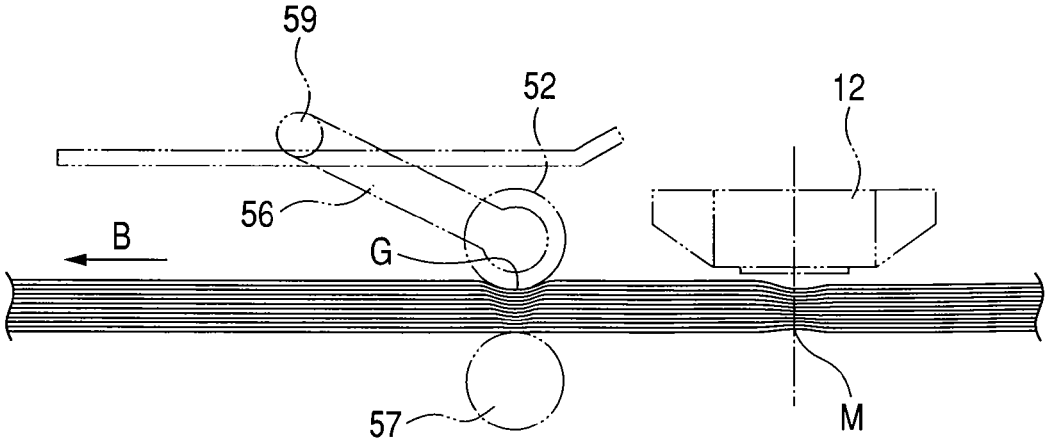
FIG. 8B shows the sheet bundle as it is nipped by a pair of rollers.

If in a state as shown in FIG. 8A wherein the needle-bound portion M is upstream of the second rockable roller 52 with respect to the sheet conveying direction, the sheet bundle is conveyed in the direction indicated by the arrow B while being nipped by and between the second rockable roller 52 and the second drive roller 57, as shown in FIG. 8B, the air collected between adjacent sheets of the sheet bundle is gathered toward the needle-bound portion M, and a slack Pa (see FIG. 9A) is formed in the sheets P between the contact point G (see FIG. 8B) of the second rockable roller 52 and the needle-bound portion M. When with this slack Pa remaining formed, the needle-bound portion M arrives at the contact point G of the second rockable roller 52, as shown in FIG. 9B, the slack portion Pa is sometimes wrinkled or twisted.

By the reason set forth above, the second rockable roller 52 lying at the nearest location on the downstream side of the needle-bound portion M with respect to the scanning direction is separated from the sheet bundle before the needle-bound portion M passes it and is retracted to thereby reduce the occurrence of the slack.

Figure 5C:
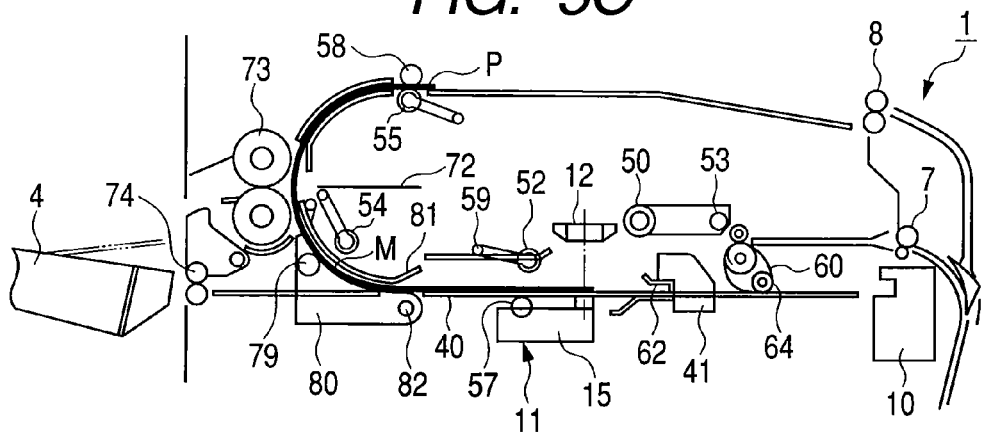
FIG. 5C shows the sheet bundle as it is conveyed to the folding device.

In FIG. 5B, in order to prevent the occurrence of the slack described above, of the second and third rockable rollers 52 and 54 opposed to the sheet bundle, the second rockable roller 52 neighboring the downstream side of the needle-bound portion M with respect to the conveying direction is separated from the sheet bundle, and the third rockable roller 54 on the most downstream side cooperates with the third drive roller 79 to nip and convey the sheet bundle. Then, when as shown in FIG. 5C, the sheet bundle has become opposed to the second, third and fourth rockable rollers 52, 54 and 55, the fourth rockable roller 55 and the fourth drive roller 58 on the most downstream side nip and convey the sheet bundle therebetween. At this time, subsequently to the second rockable roller 52, the third rockable-roller 54 is separated from the sheet bundle. Therefore, as in the case of the second rockable roller 52, by the aforedescribed reason, it hardly happens that a slack is formed in the sheets by the third rockable roller 54.

The second rockable roller 52 separated from the sheet bundle in FIG. 5B remains separated and retracted from the sheet bundle, as shown in FIG. 5C, still after the needle-bound portion M has passed it. The reason is as follows.

Figure 9A:
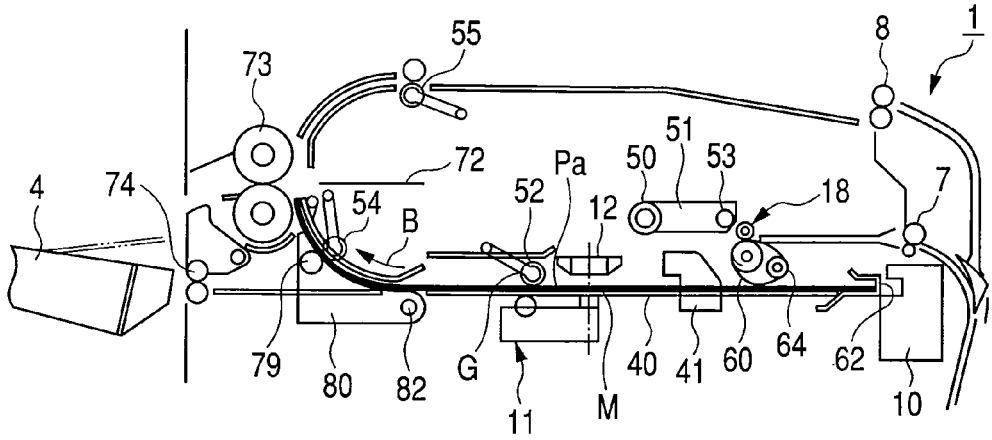
FIG. 9A is a view illustrating the process in which a slack and a wrinkle are formed in the sheets of the sheet bundle continued from FIGS. 8A and 8B, and showing a state in which a slack has been formed.
Figure 9B:
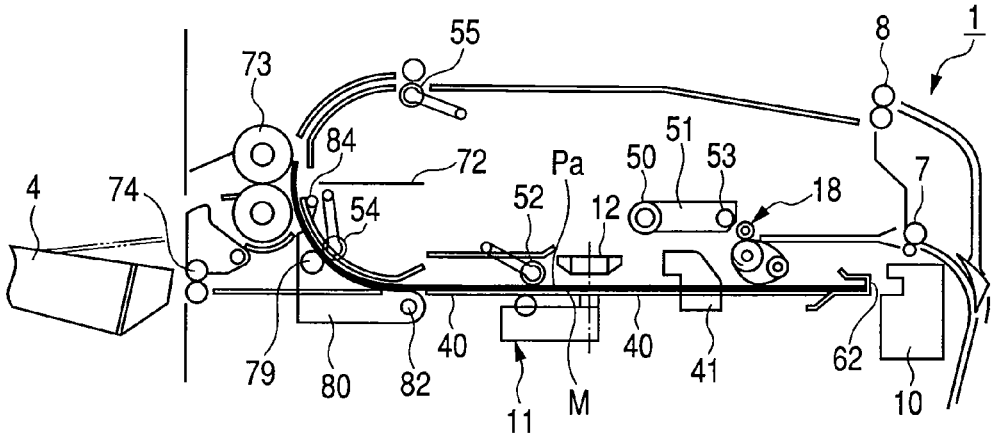
FIG. 9B shows a state in which a wrinkle has been formed.
Figure 9C:
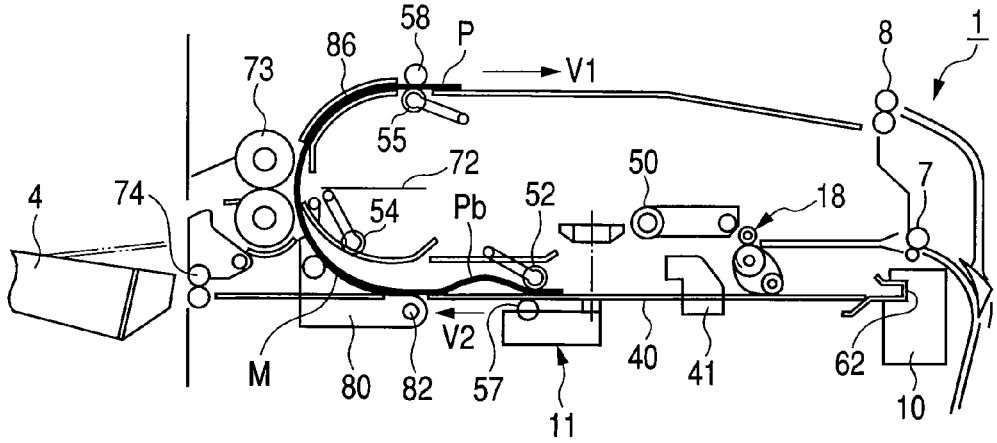
FIG. 9C shows a state in which a slack has been formed in the trailing edge of the sheet bundle.

If due to the long-period use of the sheet processing apparatus 1 or to the difference in the coefficient of friction of the sheets, as shown in FIG. 9C, the nipping conveying speed (V2) for the sheet bundle by the second rockable roller 52 and the second drive roller 57 becomes higher than the nipping conveying speed (V1) for the sheet bundle by the fourth rockable roller 55 and the fourth drive roller 58 (V1<V2), a slack Pb may occur to the upstream end side of the sheets. In such a case, the sheets may sometimes rub against one another to thereby injure the sheets or the toner images on the sheets. The slack Pb shown in FIG. 9C is exaggeratedly shown to make the occurrence situation of the slack clearly understood. Actually, the slack Pb is a little smaller.

Also, when conversely V1>V, the pulling of the sheet bundle occurs between the second drive roller 57 and the fourth drive roller 58, and both or one of the second drive roller 57 and the fourth drive roller 58 may sometimes slip relative to the sheets to thereby injure the sheets or the toner images thereon.

Figure 6A:
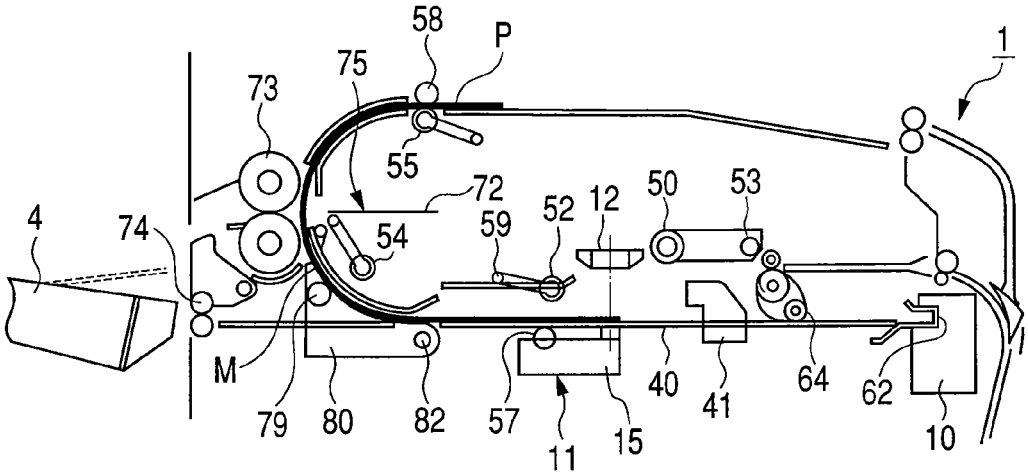
FIG. 6A is a view for illustrating the operation during the saddle stitching process continued from FIGS. 5A-5C, and showing the sheet bundle as it is conveyed to the folding device.

By the reason set forth above, the second rockable roller 52 separated from the sheet bundle still remains separated and retracted from the sheet bundle, as shown in FIG. 5C, after the needle-bound portion M has passed it. By a similar reason, the third rockable roller 54 also remains separated and retracted from the sheet bundle, as shown in FIG. 6A, after the needle-bound portion M has passed it.

That is, the sheet processing apparatus 1 according to the present embodiment, when a plurality of rockable rollers are opposed to the sheet bundle, is adapted to convey the sheet bundle by the rockable roller on the most downstream side and the drive roller opposed thereto.

As described above, in the sheet processing apparatus 1 according to the present embodiment, in order that the rockable roller on the downstream side nearest to the needle-bound portion M may be separated from the sheet bundle and the sheet bundle may be conveyed by the rockable roller upstream of the needle-bound portion M and the drive roller opposed thereto to thereby prevent the slack phenomenon as shown in FIGS. 9A and 9B from occurring, and also the rockable roller the needle-bound portion M has passed may be kept separated from the sheet bundle to thereby prevent the slack phenomenon as shown in FIG. 9C from occurring, the disposition interval between adjacent ones of the second, third and fourth rockable rollers 52, 54 and 55 is set to substantially a half or less of the length of the sheet bundle along the sheet conveying direction.

Also, the sheet processing apparatus 1 conveys the sheet bundle by the most downstream rockable roller of the plurality of rockable rollers opposed to the sheet bundle and the drive roller opposed thereto and can therefore convey the sheet bundle in a rather tightened state, and can accurately perform the folding of the sheet bundle which will be described later.

Figure 10A:
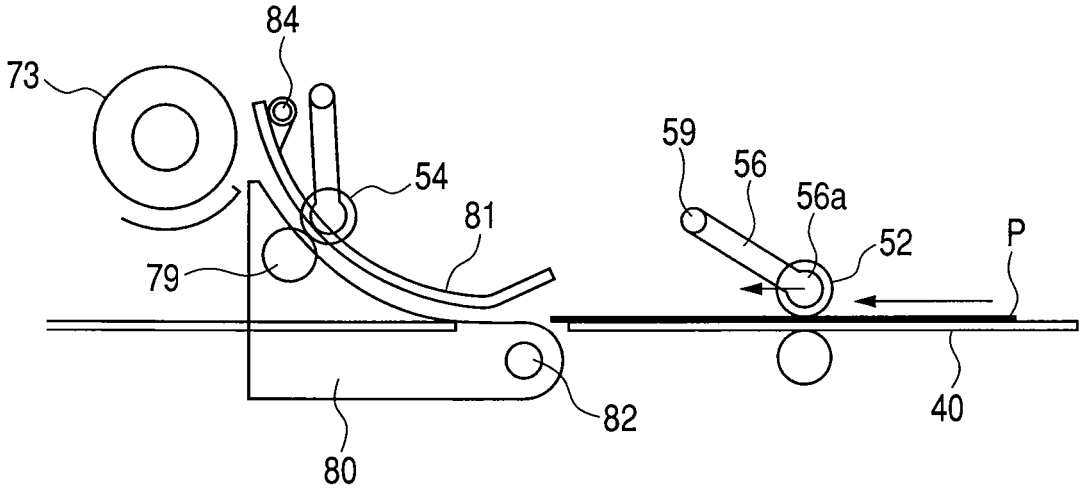
FIG. 10A is a view illustrating the disposition relationship of a first rockable roller, and showing the disposition relationship of the first rockable roller in the present embodiment.

Further, in the sheet processing apparatus 1 according to the present embodiment, as shown in FIG. 10A, the second rockable roller 52 is provided on the rocking end portion 56*a* of a rockable link 56 as a rockable member. The rocking center shaft 59 of the rockable link 56 is disposed on the more downstream side (the left side as viewed in FIG. 10A) than the second rockable roller 52 with respect to the sheet conveying direction. Owing to such a positional relationship, the second rockable roller 52, when rotated in the sheet conveying direction, acts to eat (counter) into the sheet bundle P and therefore, the second rockable roller 52 can reliably convey the sheet bundle.

Figure 10B:
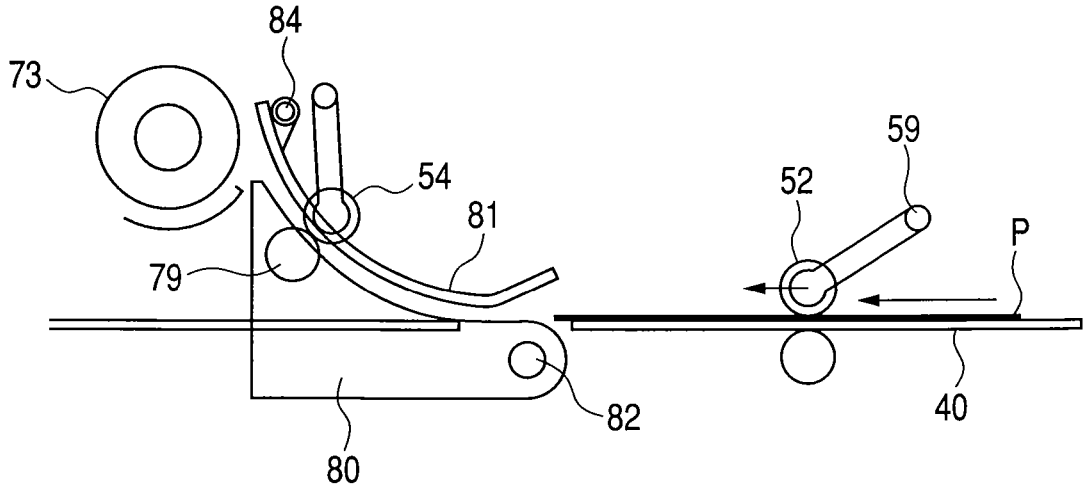
FIG. 10B shows the unpreferable disposition relationship of the first rockable roller.

If as shown in FIG. 10B, the rocking center shaft 59 is disposed on the more upstream side (the right side as viewed in FIG. 10B) than the second rockable roller 52 with respect to the sheet conveying direction, the second rockable roller 52 will be liable to separate from the sheet bundle P and a sufficient sheet conveying force cannot be obtained. As a result, the second rockable roller 52 cannot reliably convey the sheet bundle.

Figure 6B:
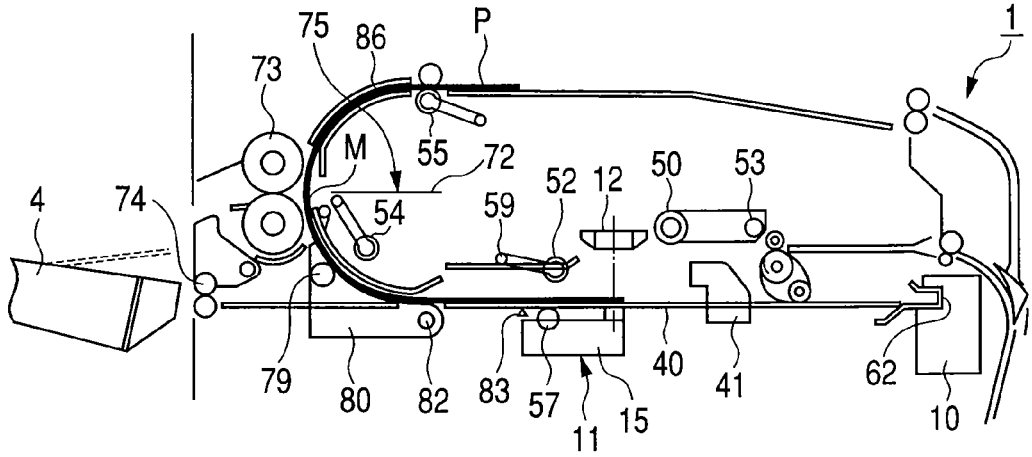
FIG. 6B shows the time when the middle of the sheet bundle has arrived at the folding device.

The sheet bundle conveyed by the fourth drive roller 58 and the fourth rockable roller 55, as shown in FIG. 6A, has its trailing edge detected by a sheet edge detecting sensor 83, as shown in FIG. 6B. The fourth drive roller 58 and the fourth rockable roller 55 convey the sheet bundle by a predetermined distance toward the downstream side on the basis of sheet length information after the sheet edge detecting sensor 83 has detected the trailing edge of the sheet bundle, and thereafter conveys the sheet bundle back to the upstream side, and oppose the needle-bound portion M to the nip of the pair of sheet folding rollers 73 and stop the conveyance of the sheet bundle. Thus, the needle-bound portion M of the sheet bundle P coincides with the nip of the pair of sheet folding rollers 73 and the sheet thrusting plate 72. Of course, the second to fourth drive rollers 57, 79, 58 and the second to fourth rockable rollers 52, 54, 55 are rotatable in forward and reverse directions.

Figure 7A:
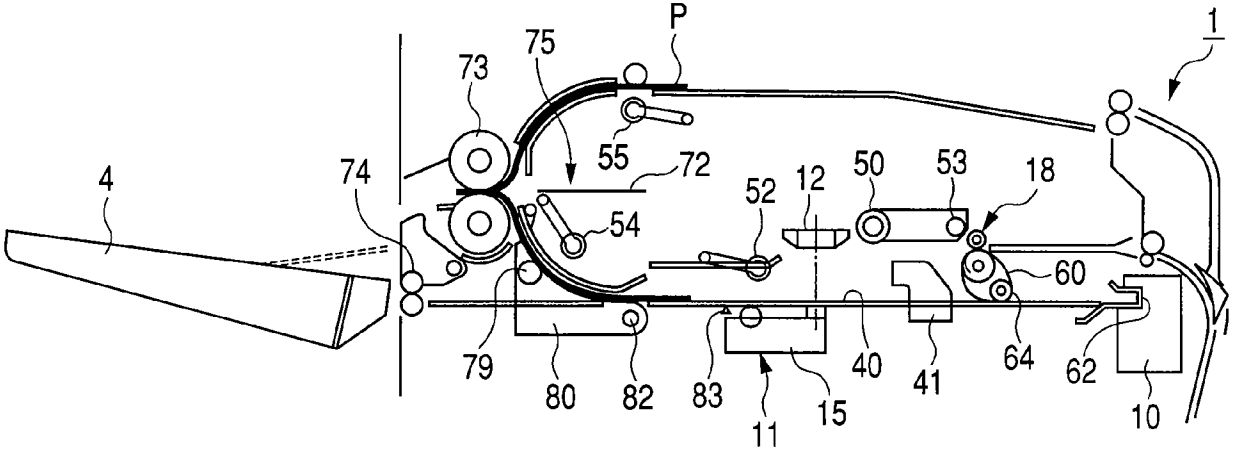
FIG. 7A is a view for illustrating the operation during the saddle stitching process continued from FIGS. 6A and 6B, and showing a state in which the sheet bundle is folded by the folding device.
Figure 7B:
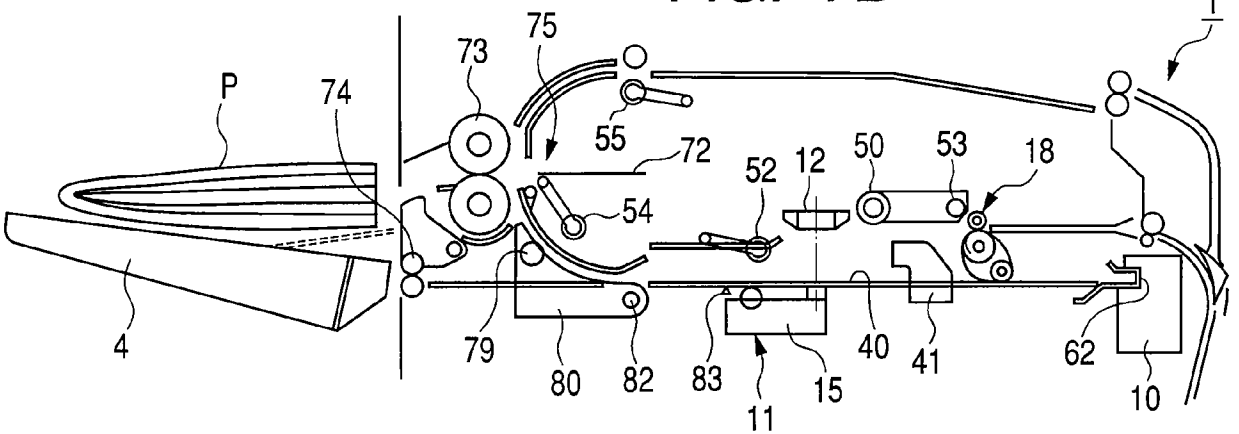
FIG. 7B shows the sheet bundle folded into two as it has been stacked on the stack tray.

Then, as shown in FIG. 7A, the sheet thrusting plate 72 pushes the center (the needle-bound portion M) of the sheet bundle P to thereby push the sheet bundle into the nip of the pair of sheet folding rollers 73. The pair of sheet folding rollers 73 conveys the sheet bundle P while nipping and folding the sheet bundle into two. Further, as shown in FIG.

7B, the sheet bundle is folded into the shape of a brochure and discharged onto the stack tray 4 by the pair of sheet folding rollers 73, and is stacked thereon. At this time, the stack tray 4 stands by at a higher position and receives as compared with the aforedescribed side stitching and sorting process discharge.

(Sheet Processing Apparatus According to a Second Embodiment)

Figure 11:
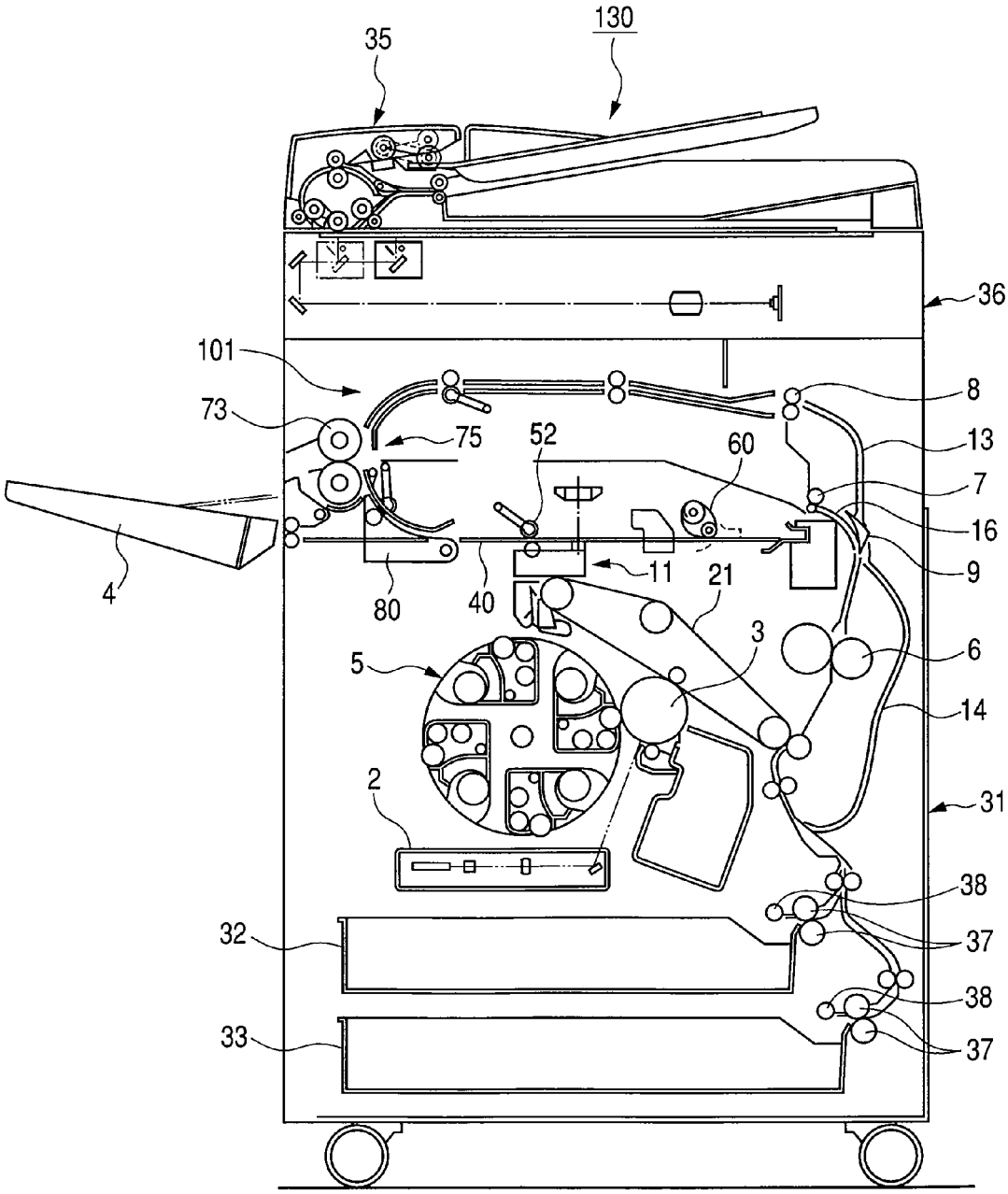
FIG. 11 is a schematic front cross-sectional view of a color copying machine as an image forming apparatus according to a second embodiment of the present invention.

FIG. 11 is a front cross-sectional view of a color copying machine 130 as an image forming apparatus provided with the sheet processing apparatus 101 according to a second embodiment.

The color copying machine 130 shown in FIG. 11 is the same in structure as the color copying machine 30 with the exception of the portions of the sheet processing apparatus 101 and therefore, like portions are given like reference numerals and need not be described.

A sheet P separated from the pair of fixing rollers 6 of the color copying machine 130, if it is set to one-side print, is guided to a conveying path 13 by a direction switching flapper 9, and is conveyed from a pair of second discharge rollers 8 into the sheet processing apparatus 101. If set to two-side print, the sheet P is guided to a conveying path 16 by the direction switching flapper 9, and has its leading edge portion once protruded to the outside of the apparatus main body 31 of the color copying machine 130 by a pair of first discharge rollers 7. When the trailing edge of the sheet P passes the direction switching flapper 9, the direction switching flapper 9 changes over and the pair of first discharge rollers 7 are reversely rotated. The sheet is guided to a conveying path by the direction switching flapper 9, and a toner image is transferred to the back side thereof, as to the front side thereof. The sheet is again heated and pressurized by the pair of fixing rollers 6, and is conveyed from the apparatus main body 31 into the sheet processing apparatus 101 by a pair of second discharge rollers 8.

The sheet processing apparatus 101 according to the present embodiment differs from the sheet processing apparatus 1 according to the first embodiment in that it is adapted to receive the sheet from the pair of second discharge rollers 8. Also, provision is not made of the first rockable roller 50, the rockable arm 51, the rockable roller shaft 53 and the driven roller 18*b*. The other portions are the same as those of the sheet processing apparatus 1 according to the first embodiment. The same portions are given the same reference numerals and need not be described.

As shown in FIG. 11, the sheet processing apparatus 101 according to the present embodiment is also provided with a process tray 40 and a stack tray 4. The sheet processing apparatus 101 according to the present embodiment has a case where it forms sheets P discharged from the pair of second discharge rollers 8 of the color copying machine 130 into the shape of a bundle on the process tray 40 and intactly discharges them onto the stack tray, a case where it binds the sheet bundle at the end portion thereof by an end portion stapler 10 and discharges it onto the stack tray 4, and a case where it binds the sheet bundle by an intermediate portion stapler 11 for binding the intermediate portion of the sheet bundle, folds the sheet bundle into two in the shape of a brochure on a sheet thrusting plate 72 and a pair of sheet folding rollers 73, and discharges it onto the stack tray 4.

(Description of the Operation During Sorting Process and Side Stitching Process)

Figure 12A:
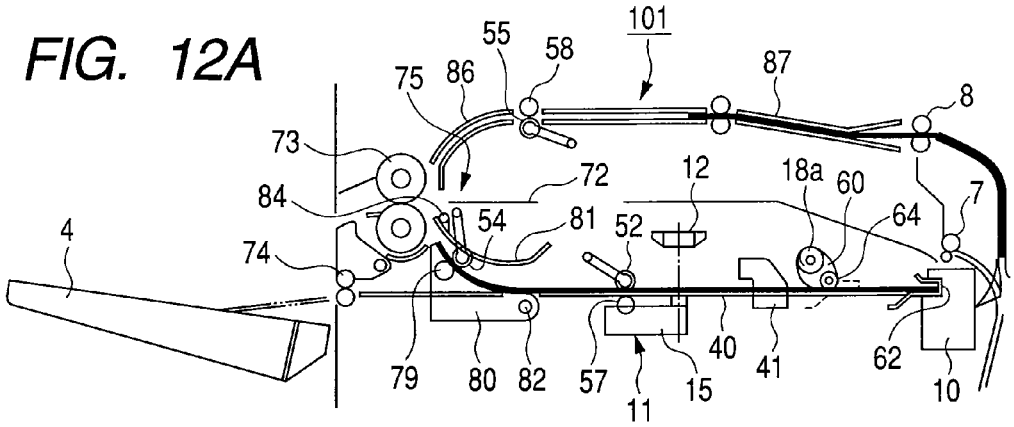
FIG. 12A is a view for illustrating the operation of side stitching process by a sheet processing apparatus in the second embodiment of FIG. 11, and showing a sheet as it is fed onto a process tray.
Figure 12B:
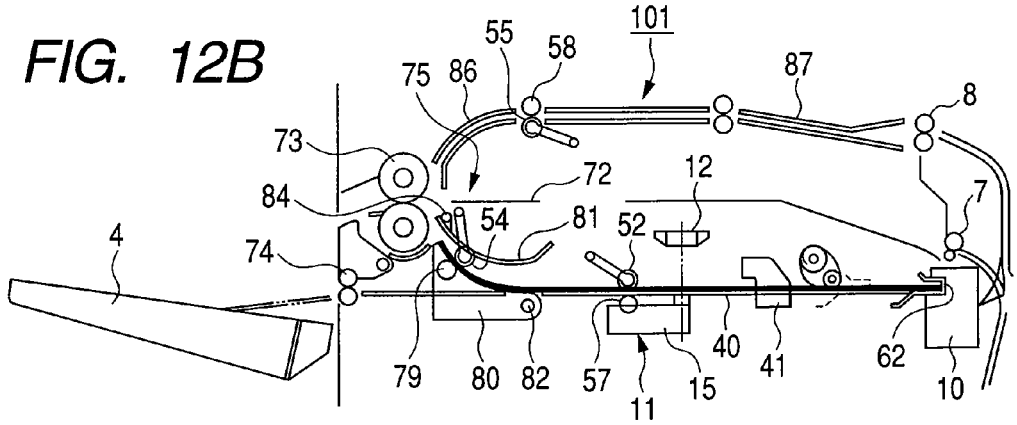
FIG. 12B shows a predetermined number of sheets as they have been stacked on the process tray.
Figure 12C:
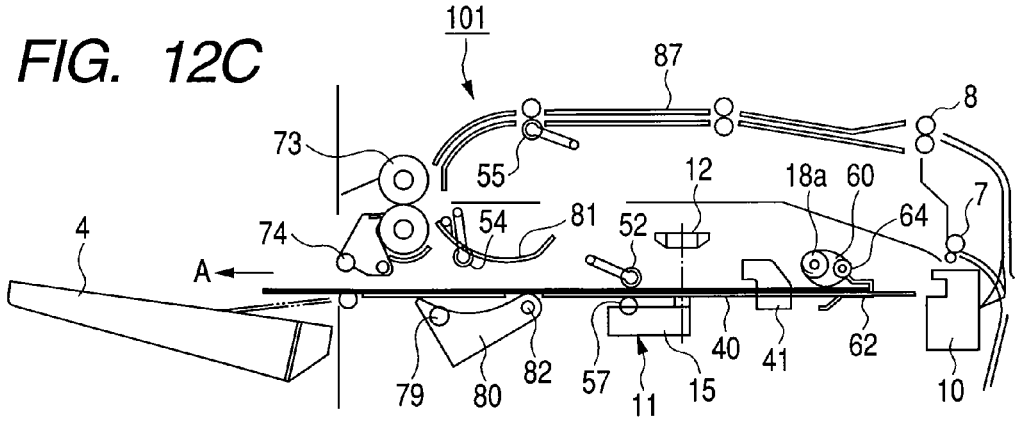
FIG. 12C shows a sheet bundle as is being discharged onto a stack tray.

As shown in FIGS. 12A to 12C, the sheet P discharged from the pair of second discharge rollers 8 of the color copying machine 130 is discharged onto the process tray 40. At this time, a curved lower guide 80 is located above the process tray 40 with a third drive roller 79, and a curved upper guide 81 is also retracted upwardly about a rotary shaft 84 with a third rockable roller 54.

The sheet P fed out from the pair of second discharge rollers 8 is guided by a receiving path 87, a curved path 86 and the third drive roller 79, and abuts against a stopper 62. The sheet P has its leading edge (the right edge as viewed in FIG. 12B) arranged properly by the stopper 62. Also, the sheet P has its side edges aligned by a pair of aligning plates 41 (seen as one by overlap in FIG. 12B) operated by driving means (e.g. a rack and a pinion gear drive source) and controlling means, not shown. When as shown in FIG. 12B, a predetermined number of sheets are stacked on the process tray 40, the curved lower guide 80 is downwardly pivotally moved as shown in FIG. 12C. Thereupon, the left edge of the sheet bundle is stacked on the process tray 40. Then, a pair of final discharge rollers 74 are opened.

The sheet bundle, as shown in FIG. 12C, is conveyed in the direction indicated by the arrow A by the trailing edge stopper 62, the second rockable roller 52, the pair of final discharge rollers 74, etc. and is stacked on the stack tray 4. When the sheet bundle is being conveyed in the direction indicated by the arrow A, a return belt pulley 64 is moved away from the process tray 40, and raises a return belt 60 from the inside thereof. The return belt 60 is separated from the sheet bundle conveyed in the direction indicated by the arrow A so as not to hinder the conveyance of the sheet bundle.

The above description of the operation is the description of the operation in a case where the sheets are formed into the shape of a bundle and are discharged onto the stack tray 4, but in a case where the leading edge portion (the right edge portion as viewed in FIG. 12B) of the sheet bundle is to be bound, a predetermined number of sheets are stacked on the process tray 40 and assume the shape of a bundle, and the leading edges and side edges of the sheets are aligned, whereafter an end portion stapler 10 operates to bind the sheet bundle.

In this case, the second rockable-roller 52 and the pair of final discharge rollers 74 are successively separated from the sheet bundle as needles which have bound the end portion of the sheet bundle approach them, and can reduce the occurrence of a slack in the sheets caused by the air collected between adjacent ones of the sheets to thereby reduce the occurrence of wrinkles or twists. Also, when the second rockable roller 52 and the pair of final discharge rollers 74 are successively separated from the sheet bundle, it never happens that they are damaged by the needles. The second rockable roller 52 may be separated from the sheet bundle from the first, and the sheet bundle may be conveyed for discharge by only the pair of final discharge rollers 74.

(Description of the Operation During Saddle Stitching Process)

Figure 13A:
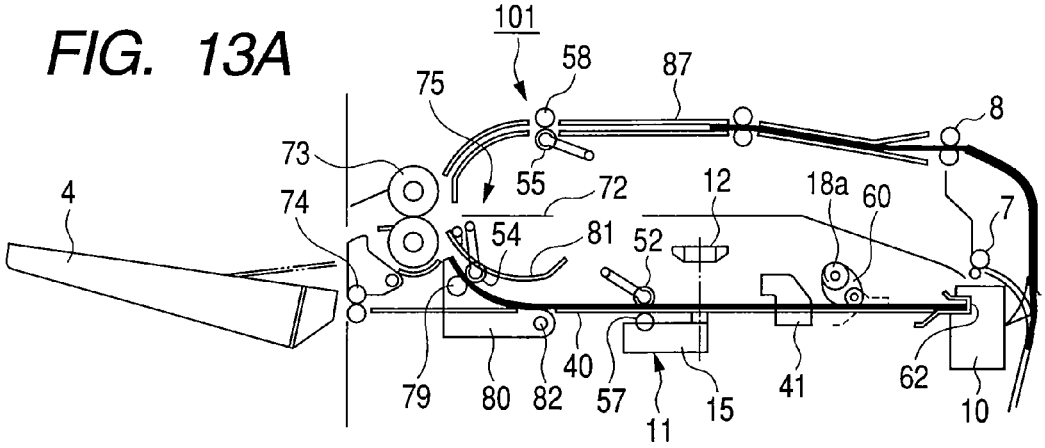
FIG. 13A is a view for illustrating the operation during the saddle stitching process by the sheet processing apparatus in the second embodiment of FIG. 11, and showing a sheet as it is fed into the sheet processing apparatus.
Figure 13B:
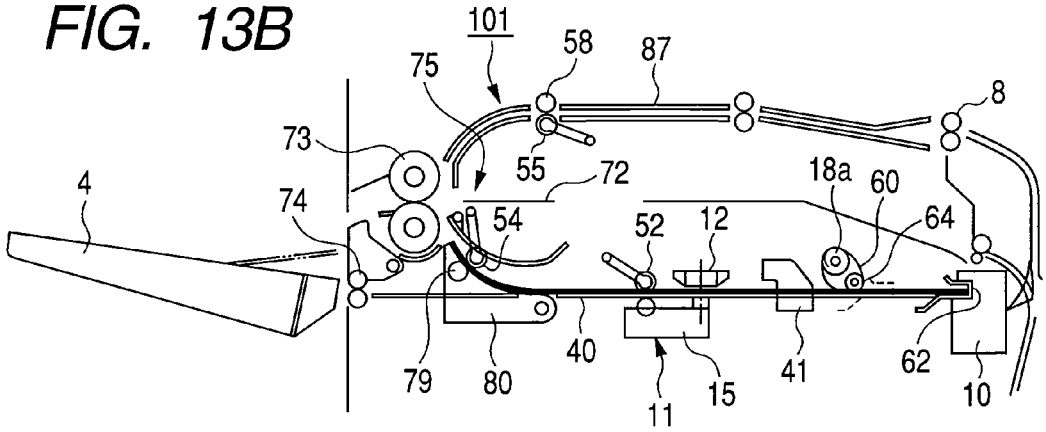
FIG. 13B shows a predetermined number of sheets as they have been stacked on the process tray.
Figure 13C:
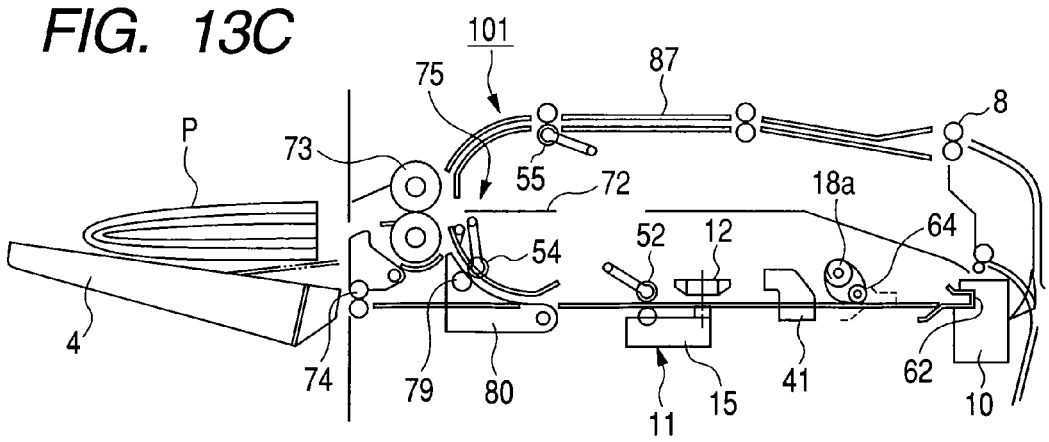
FIG. 13C shows a sheet bundle folded into two as it has been stacked on the stack tray.
Figure 14:
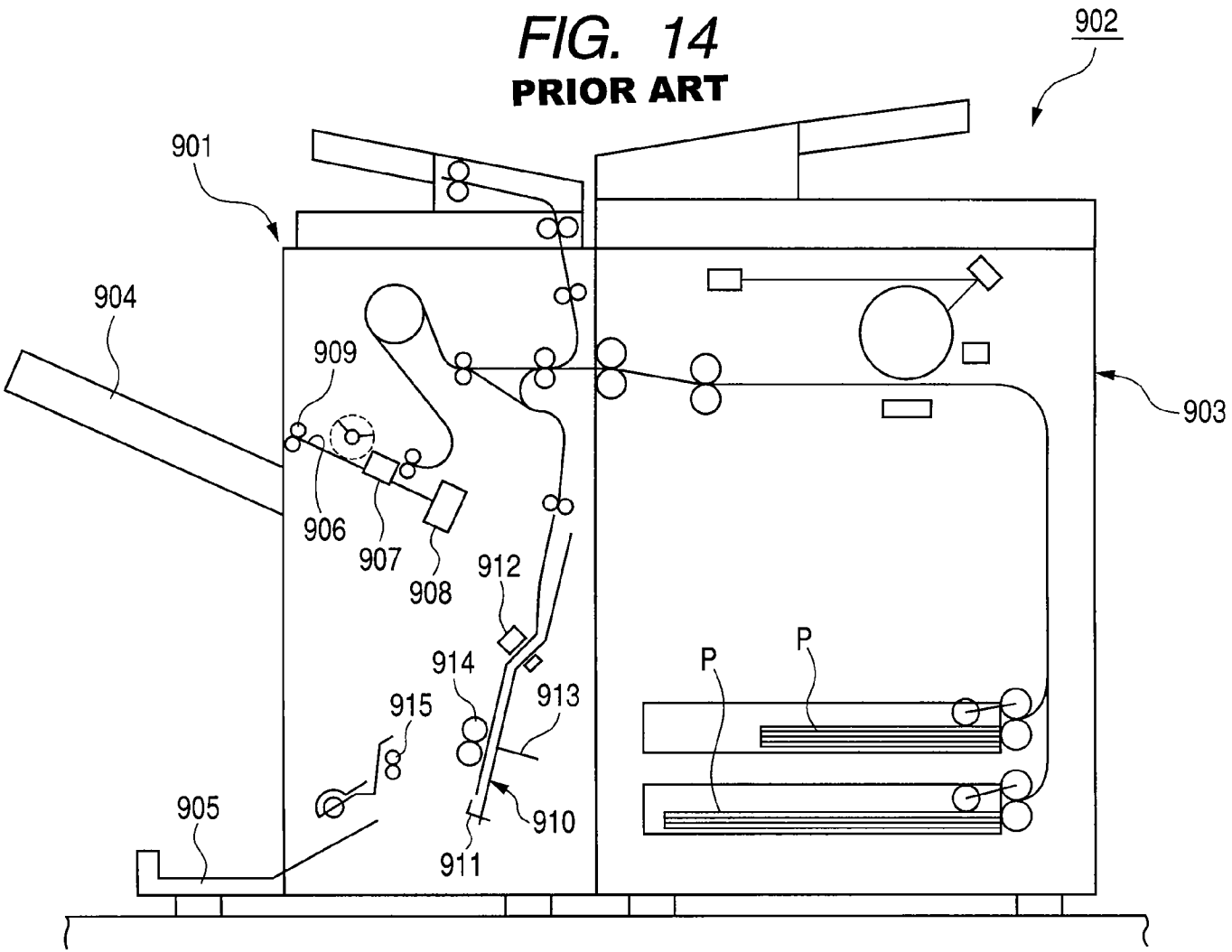
FIG. 14 PRIOR ART
FIG. 14 is a schematic front cross-sectional view of a color copying machine as a conventional image forming apparatus provided with a conventional sheet processing apparatus.

As shown in FIGS. 13A and 13B, the sheets P discharged from the pair of second discharge rollers 8 of the color copying machine 130 are stacked on the process tray 40 by processes similar to the processes shown in FIGS. 12A and 12B. The sheets stacked in the shape of a bundle on the process tray 40 have their intermediate portion bound by the intermediate portion stapler 11 with the aid of operations similar to the operations shown in FIGS. 5B to 7B, and are folded into two by a folding device 75, and are discharged onto the stack tray 4, as shown in FIG. 13C.

The trailing edge (the left edge as viewed in FIGS. 13A and 13B) of the sheet present on a curved path 44 or the process tray 40 is held down from above it by a flapper (not shown) so that a succeeding sheet may not pass under the preceding sheet. Thus, the succeeding sheet passes over the flapper and lies on the preceding sheet in the order of pages. The flapper is adapted to be once raised when the succeeding sheet lies on the preceding sheet, and hold down the trailing edge of that succeeding sheet, and guide the next succeeding sheet onto the preceding sheet so as to lie thereon.

Each of the above-described sheet processing apparatuses 1 and 101 is adapted to bind a sheet bundle by needles, but may be a sheet processing apparatus which adhesively secures sheets to one another by a toner instead of needles to thereby bind the sheets. That is, such sheet processing apparatus is adapted to heat and pressurize the toner transferred to the bound portion of the sheets together with the sheets in the apparatus main body 31 by a heating and pressurizing device provided instead of a stapler to thereby fuse the toner and adhesively secure the sheets to one another. Again in such a sheet processing apparatus, the sheet bundle can be conveyed without wrinkles, twists or the like being caused to the sheet bundle after processed. Also, the sheets are adhesively secured to one another by the toner, whereby the thickness of the bound portion becomes more or less great, but when the bound portion passes the second and third rockable rollers 52 and 54, the second and third rockable rollers 52 and 54 are separated from the sheet bundle and therefore, it never happens that the second and third rockable rollers 52 and 54 are damaged.

In the sheet processing apparatuses 1 and 101 according to the above-described embodiments, when the sheet bundle is being conveyed by any one of the second, third and fourth rockable rollers 52, 54 and 55, and the pair of final discharge rollers 74, the rockable roller on the downstream side nearest to the bound portion of the sheet bundle before the bound portion passes it is separated from the sheet bundle and therefore, the occurrence of a slack in the sheets caused by the air collected between adjacent ones of the sheets of the sheet bundle being gathered to the bound portion M can be reduced to thereby reduce the occurrence of wrinkles or twists in the sheet bundle.

Also, the bound portion M passes the pair of rollers, but the pair of rollers are separated from the sheet bundle, whereby the pairs of rollers are less often damaged by the bound portion, and can smoothly convey the sheet bundle.

In each of the sheet processing apparatuses 1 and 101 according to the above-described embodiments, of the plurality of rockable rollers 52, 54 and 55, the rockable roller located next to the downstream side of the bound portion M of the conveyed sheet bundle is adapted to be separated from the sheet bundle and therefore, the occurrence of a slack in the sheets caused by the air collected between adjacent ones of the sheets of the sheet bundle being gathered to the bound portion M can be reduced to thereby reduce the occurrence of wrinkles or twists in the sheet bundle.

In each of the sheet processing apparatuses 1 and 101 according to the above-described embodiments, the pairs of rollers spaced apart from the sheet bundle are adapted to be held while remaining spaced apart, the toner image becomes less often injured without the downstream side of the sheets with respect to the conveying direction being slackened.

In each of the sheet processing apparatuses 1 and 101 according to the above-described embodiments, of the pairs of rollers opposed to the sheet bundle, only the pair of rollers on the most downstream side are adapted to nip and convey the sheet bundle therebetween and therefore, the occurrence of a slack in the sheets caused by the difference in the sheet bundle nipping conveying speed between the pairs of rollers and the slip of the rollers relative to the sheets can be prevented to thereby reduce the injury of the toner image and smoothly convey the sheet bundle.

In each of the sheet processing apparatuses 1 and 101 according to the above-described embodiments, the interval between adjacent pairs of rollers is set to an interval which enables the sheet bundle to be conveyed by the pair of rollers on the downstream side with respect to the sheet conveying direction when the pair of rollers on the upstream side with respect to the sheet conveying direction become spaced apart from the sheet bundle and therefore, the sheet bundle can always be reliably conveyed with a slack being hardly caused to the sheets.

In each of the sheet processing apparatuses 1 and 101 according to the above-described embodiments, as shown in FIG. 5B, the fourth rockable roller 55 located next to the downstream side of the leading edge of the conveyed sheet bundle is adapted to be retracted to a position in which it does not contact with the leading edge and therefore, it hardly happens that the leading edge of the sheet bundle is caused to enter between the fourth rockable roller 55 and the fourth drive roller 58 to thereby injure the sheet bundle.

In the sheet processing apparatus 1 according to the first embodiment, the direction in which the sheets are fed onto the process tray 40 is the same as the direction in which the sheet bundle is discharged from the process tray 40 and therefore, as compared with a case where the two directions are opposite to each other, the sheet conveying distance when the sheets are stacked on the process tray 40 can be shortened to thereby shorten the sheet processing time.

In the sheet processing apparatus 101 according to the second embodiment, the direction in which the sheets are fed onto the process tray 40 is opposite to the direction in which the sheet bundle is discharged from the process tray 40 and therefore, the leading edges of the sheets on the process tray can be aligned, thus enhancing an aligning property.

In each of the color copying machines 30 and 130 according to the above-described embodiments, the image reading apparatus 36 and the apparatus main body 31 having the photosensitive drum 3 are disposed in a vertical direction, and the sheet processing apparatus 1, 101 is provided between the apparatus 36 and the apparatus main body 31 and therefore, the overlooking area of the color copying machine can be made small to thereby make the color copying machine compact and also it can be made easy to take out the processed sheet bundle. Also, the conveying path for the sheet can be shortened.

This application claims priority from Japanese Patent Application No. 2004-211805 filed on Jul. 20, 2004, which is hereby incorporated by reference herein.

What is claimed is:

1. An image forming apparatus comprising:

an image forming portion which forms images on sheets; and a sheet processing apparatus which processes the sheets on which the images have been formed by said image forming portion, said sheet processing apparatus including:

a stacking portion on which the sheets are stacked;

a binding unit which binds the sheets stacked on said stacking portion into a sheet bundle; and a plurality of conveying portions, arranged along a sheet conveying direction for independent movement toward and away from the sheet bundle, which convey the sheet bundle, wherein when said plurality of conveying portions convey the sheet bundle bound by said binding unit, one conveying portion of said plurality of conveying portions is spaced apart from the sheet bundle while a bound portion of the sheet bundle, bound by said binding unit, passes said one conveying portion, and another conveying portion located downstream of said one conveying portion with respect to the sheet conveying direction conveys the sheet bundle so as to pass the bound portion through said one conveying portion spaced apart from the sheet bundle, and wherein the sheet processing apparatus is provided in an upper portion of said image forming portion.

2. An image forming apparatus according to claim 1, wherein said binding unit includes an end portion binding unit which binds an end portion of the sheet bundle, and an intermediate portion binding unit which binds an intermediate portion of the sheet bundle with respect to the sheet conveying direction, and wherein said image forming apparatus further comprises:

a folding device which folds the sheet bundle bound by said intermediate portion binding unit at the intermediate portion thereof;

a first guide path which guides the sheet bundle bound by said end portion binding unit; and a second guide path which guides the sheet bundle bound by said intermediate portion binding unit to said folding device, said second guide path being curved and branched off from said first guide path, said folding device being provided inside a curved portion of said second guide path.

3. An image forming apparatus according to claim 1, wherein still after the bound portion of the sheet bundle has passed said one conveying portion spaced apart from the sheet bundle, said one conveying portion is kept spaced apart.

4. An image forming apparatus according to claim 1, wherein of said plurality of conveying portions, the conveying portions opposed to the sheet bundle are such that the most downstream conveying portion conveys the sheet bundle and the remaining conveying portion is kept spaced apart from the sheet bundle.

5. An image forming apparatus according to claim 1, wherein an arrangement interval between adjacent conveying portions of said plurality of conveying portions is set to an interval which enables, when the sheet conveying portion on the upstream side with respect to the sheet conveying direction has been spaced apart from the sheet bundle, the sheet bundle is conveyed by the conveying portion downstream of said spaced-apart sheet conveying portion with respect to the sheet conveying direction.

6. An image forming apparatus according to claim 1, wherein said one conveying portion has a pair of conveying rotary members which nip and convey the sheet bundle therebetween, at least one of said pair of conveying rotary members is provided on a pivotally movable end portion of a pivotally movable member movable toward and away from the sheet bundle, and a rotation center of said pivotally movable member is located on the more downstream side than said one rotary member with respect to the sheet conveying direction.

7. An image forming apparatus according to claim 1, further comprising a reading device which reads the image of an original, above said sheet processing apparatus.

* * * * *